US005642870A

United States Patent [19]

Sargis

[11] Patent Number: 5,642,870

[45] Date of Patent: Jul. 1, 1997

[54] SWITCH STAND

[76] Inventor: Ike Sargis, 6532 Albert Ave., Morton Grove, Ill. 65008

[21] Appl. No.: 562,241

[22] Filed: Nov. 22, 1995

Related U.S. Application Data

[63] Continuation of Ser. No. 268,478, Jun. 30, 1994, abandoned, which is a continuation of Ser. No. 926,063, Aug. 5, 1992, abandoned.

[51] Int. Cl.[6] ..... B61L 5/02

[52] U.S. Cl. ..... 246/406; 246/410

[58] Field of Search ..... 246/393, 401, 246/404, 405, 406, 407, 409, 410, 411, 489

[56] References Cited

U.S. PATENT DOCUMENTS

| | | | |
|---|---|---|---|
| 140,917 | 7/1873 | Hanchett . | |
| 175,423 | 3/1876 | Chambers . | |
| 321,107 | 6/1885 | Hilburn et al. . | |
| 378,025 | 2/1888 | Tracy . | |
| 383,654 | 5/1888 | Pollock | 246/410 |
| 406,500 | 7/1889 | Boyd | 246/410 X |
| 720,961 | 2/1903 | Patenall | 246/410 |
| 731,643 | 6/1903 | Williams et al. | 246/410 X |
| 856,336 | 6/1907 | Carter . | |
| 907,114 | 12/1908 | Anderson . | |
| 993,089 | 5/1911 | McGuire . | |
| 1,024,279 | 4/1912 | Osburn . | |
| 1,031,404 | 7/1912 | Wenrich . | |
| 1,140,965 | 5/1915 | Dubois et al. . | |
| 1,169,106 | 1/1916 | Anderson . | |
| 1,278,623 | 9/1918 | Fleagle . | |
| 1,318,767 | 10/1919 | Kimack | 246/406 X |
| 1,418,127 | 5/1922 | Cesar . | |
| 1,478,888 | 12/1923 | Butler | 246/410 |
| 1,799,009 | 3/1931 | Dougherty . | |
| 2,045,930 | 6/1936 | Taylor . | |
| 2,559,477 | 7/1951 | Stephenson . | |
| 3,652,849 | 3/1972 | Kleppick . | |
| 4,337,914 | 7/1982 | Rich . | |
| 5,052,642 | 10/1991 | Peters | 246/393 |

FOREIGN PATENT DOCUMENTS

| | | |
|---|---|---|
| 14247 | of 1896 | United Kingdom . |
| 16142 | of 1905 | United Kingdom . |

*Primary Examiner*—David A. Bucci
*Assistant Examiner*—Scott L. Lowe
*Attorney, Agent, or Firm*—Brinks Hofer Gilson & Lione

[57] ABSTRACT

Improved railroad switch stands having an improved angled and elongate lever arm to protect the user from back injuries. The lever arm is angled so that an arc of less than 180 degrees is provided for movement of the lever arm from a first position to a second position.

26 Claims, 2 Drawing Sheets

Fig. 4
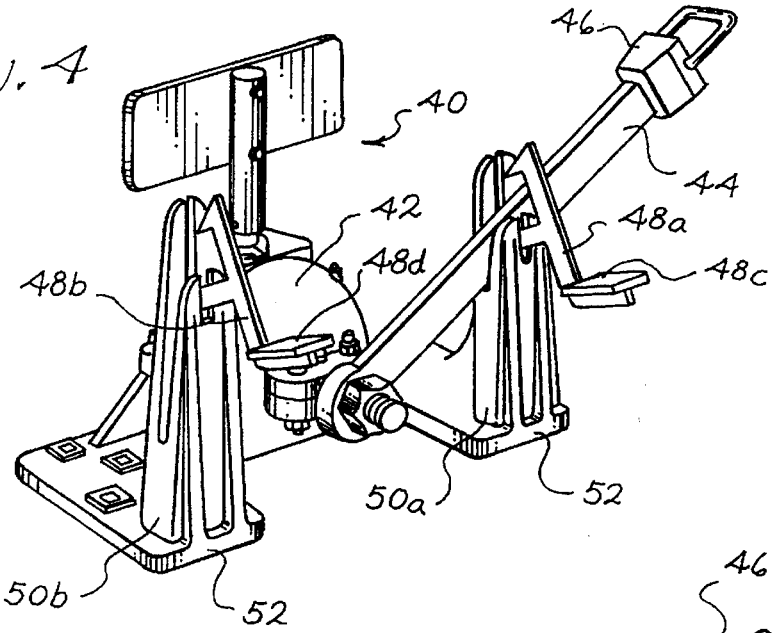
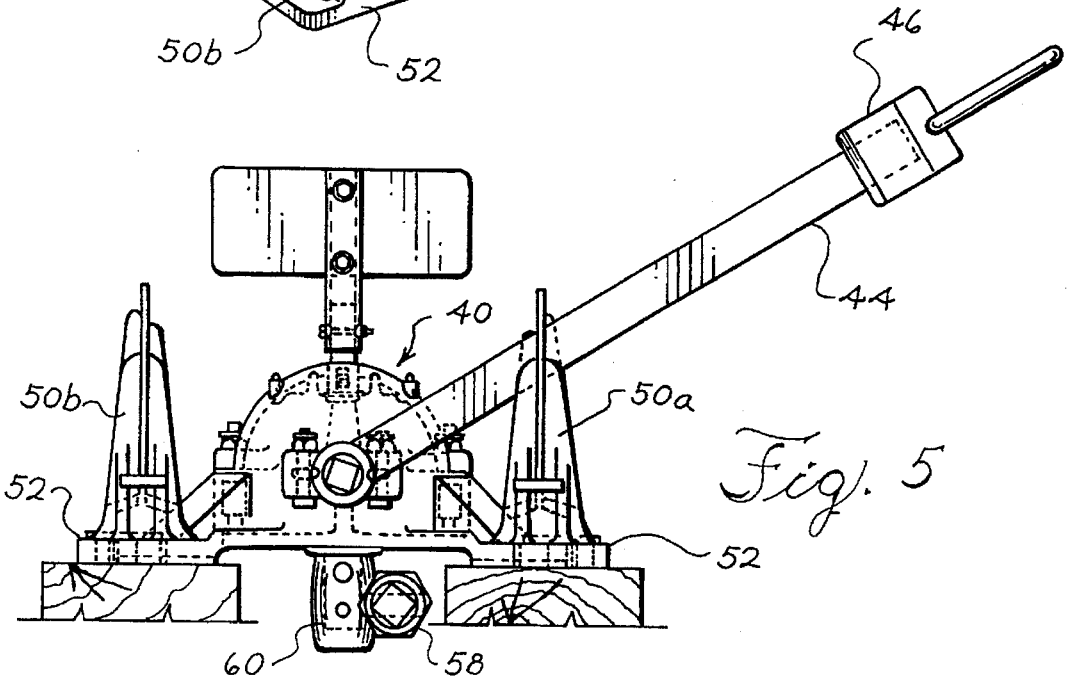
Fig. 5
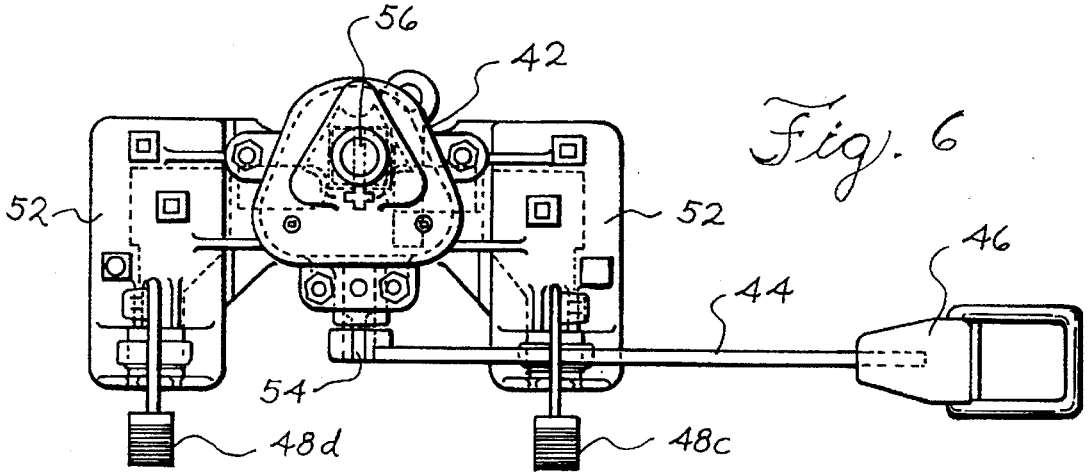
Fig. 6

SWITCH STAND

This application is a continuation of application Ser. No. 08/268,478, filed Jun. 30, 1994, which is a continuation of application Ser. No. 07/926,063, filed on Aug. 5, 1992, both abandoned.

FIELD OF THE INVENTION

This invention relates to railroad switching devices and particularly to railroad switch stands.

BACKGROUND OF THE INVENTION

Railroad yards generally have manually and/or automatically operated switching devices for switching railroad cars from one track to another. These switching devices are well known in the art and have been described for example, in U.S. Pat. Nos. 3,652,849 and 4,337,914 both incorporated by reference herein and made a part hereof.

Generally, a pair of stationery rails and a pair of switching rails are arranged so that the switching rails can be moved to keep trains on a main track or divert them to a branch track. The switching rails are moved by a switching device which includes a connecting rod that extends beneath the tracks to connections with the switching rails.

The switching devices typically include a switch stand to one side of the rails which can be operated either manually or automatically. When operated by hand, the switch is moved to a switch point by throwing a lever arm 180 degrees. For example, in the prior art, a weighted lever arm lying horizontally on the ground or at the base of the switch stand is lifted and thrown 180 degrees to the opposite side of the switch stand where it rests again horizontally on the ground or base. The weight and horizontal position of the lever arm prevents bouncing and accidental repositioning of the switch which could cause derailment. However, due to the large arc of throwing the lever arm and the amount of force and bending over required to carry out this operation, many switchmen have experienced back compression and resulting back and leg injuries.

It is therefore a principal object of the present invention to provide a switch stand which eliminates or significantly reduces back bending and switch throwing force which may cause back and leg injuries to switchmen, while still enabling a simple switch stand construction.

SUMMARY OF THE INVENTION

The present invention eliminates the foregoing disadvantages in the art of railroad switch stands by providing an improved angled and elongate switch stand lever arm or handle resting on an elevated retaining means which requires an arc of less than 180 degrees and preferably about 120 degrees or less, so as to reduce the amount of force necessary to operate the switching device and thus prevent switchmen from incurring back and leg injuries. The improved switch stand lever arm is also at least about 36 inches in length and is not significantly weighted to further reduce the amount of force necessary to operate the switch.

THE DRAWINGS

In the accompanying drawings, which exemplify the best mode presently contemplated of carrying out the invention:

FIG. 4 is a perspective view of another embodiment of a railroad switch stand according to the invention;

FIG. 5 is a side elevation of the switch stand of FIG. 4;. and

FIG. 6 is a plan view of the switch stand of FIG. 4.

DETAILED DESCRIPTION OF THE INVENTION

Figure 1:
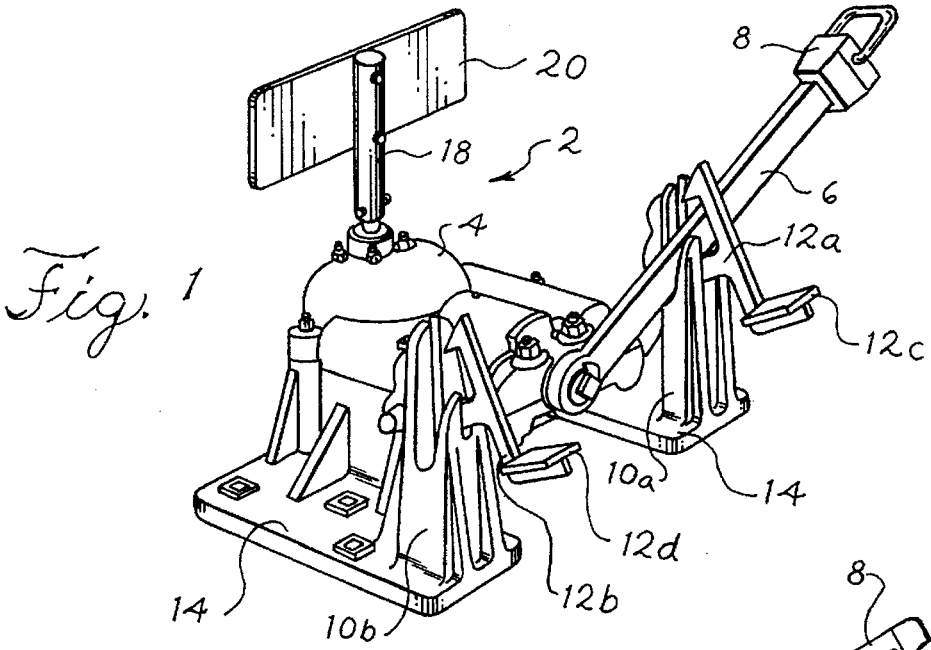
FIG. 1 is a perspective view of a railroad switch stand with an angled and elongate handle according to the invention.
Figure 2:
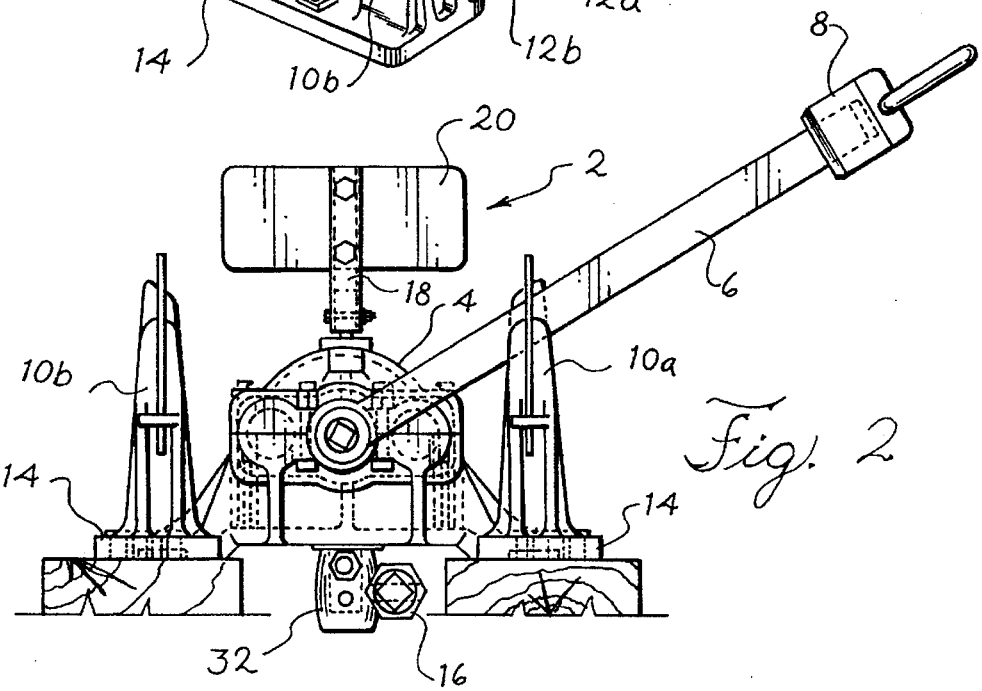
FIG. 2 is a side elevation of the switch stand of FIG. 1.
Figure 3:
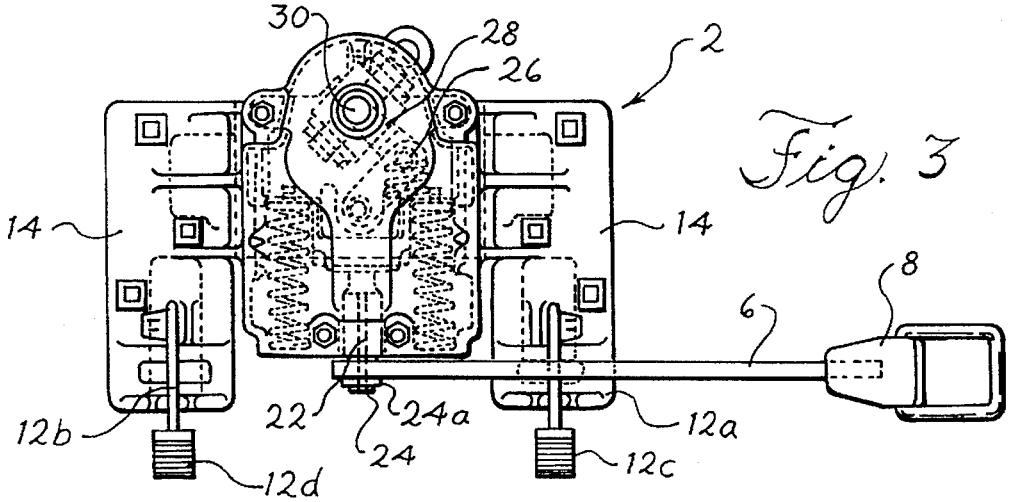
FIG. 3 is a plan view of the switch stand of FIG. 1.

According to one embodiment of the invention, as shown in FIGS. 1, 2 and 3, a switch stand 2 is provided with a housing means 4 having an angled and elongate lever arm or handle 6 with a handle grip 8. A bar member extends from one side and is preferably bent with two approximate right angles to define a closed area and a portion for grasping or gripping the handle. The handle 6 is locked into a first position or second position resting in elevated retaining means such as cradles 10*a* and 10*b* by locking means such as locking devices 12*a* and 12*b* mounted on the cradles 10*a* and 10*b* of the base 14. Movement of the handle 6 from one position to the other operates to move a conventional connecting rod 16 secured by conventional means to a pair of switch points on a pair of alternative railroad tracks (not shown). When the handle 6 is in a first position resting in cradle 10*a*, a train moves along one set of tracks, and in a second position in cradle 10*b*, along a set of branch tracks. An optional shaft 18 extends upwardly from the housing 4 which has a signal 20 which moves with the switch operation to indicate the position of the tracks.

The switch stand 2 is operated by a switchman releasing the locking devices 12*a* and 12*b* by pressure on the foot rest portions 12*c* and 12*d* whereby handle 6 is moved from a first position in cradle 10*a* to a second position at cradle 10*b*. The locking devices 12*a* and 12*b* then lock the handle into its second position.

The handle 6 is mounted to a switch operating mechanism such as drive shaft 22 by conventional means such as toggle 24 and toggle washer 24*a*. The switch operating mechanism shown comprises the drive shaft 22 which extends to an opposite end of the housing 4 by conventional linkage such as link 26 connected to fork 28 which is connected to spindle assembly 30. The spindle assembly 30 moves the connecting rod 16 via crank 32.

As shown in FIG. 3, springs 26, which are activated upon removal of the handle 6 from its first position, facilitate automatic repositioning of the handle 6 in the second position.

As seen in FIGS. 4, 5 and 6, another embodiment of the switch stand of the invention can be made with basically the same outer configuration of the automatic switch stand of FIGS. 1, 2 and 3, except that in this embodiment, movement of the lever arm or handle is a completely manual operation. In this embodiment (FIGS.4–6), the switch stand 40 comprises a housing 42 having an angled and elongate lever arm or handle 44 with a handle grip 46. Locking device 48*a* holds the handle 44 in a first position in elevated retaining means such as cradle 50*a* on the base 52 until released by pressure on foot rest 48*c*. Upon release of the locking devices 48*a* and 48*b*, the handle can be manually moved to a second position in elevated cradle 50*b*. As in the embodiment of FIGS. 1–3, in the second embodiment, the handle 44 is mounted to a drive shaft 54 by conventional means. The drive shaft 54 extends to an opposite end of the housing by conventional linkage which is connected to a spindle assembly 56. The spindle assembly 56 moves the connecting rod 58 via crank 60. However, in this embodiment (FIGS. 4–6), the entirely manual movement of the handle 44 will operate to move the connecting rod 58 which, in turn, moves the switch rails (not shown) from a first setting to a second setting.

The above-described embodiments illustrate the improvement comprising an angled and elongate handle which requires movement of less than 180 degrees from the handle's first position to its second position. Preferably, the movement required to move the handle from a first position to a second position is about 120 degrees or less. Most preferably, the handle is held in its resting, locked first or second position at an angle of from about 40 to 45 degrees from the ground on which the switchman is standing during operation of the switch. This angled handle position enables the switchman to avoid bending, stooping, and shoulder lifting in throwing the switch from one position to another, thus avoiding leg and back injuries.

Further, the arm is elongated to a length of about 36 inches or more from the fulcrum of the handle, for example, at the connection of the handle 6 to the drive shaft 22 in FIG. 3. This elongated handle design further operates to reduce injurious movement of the switchman during the switch throwing operation. Also, the handle of the switch stand of the invention need not be significantly weighted since the locking devices hold the handle in a resting, locked position. By "not significantly weighted" is meant that the handle or lever arm does not have to have weight added to keep the handle from bouncing or vibrating into another position as in the prior art. This reduction in weight adds to the ease of use of the switch stand and avoidance of injuries. Also, the locking devices prevent accidental movement of the improved handle, such as from vibration of a train, which could cause derailment.

While this invention is described with reference to specific embodiments, it should be understood that the invention can be adapted to different embodiments without departing from the spirit and scope of the invention.

What is claimed is:

1. A switch stand comprising:

a base;

a housing resting on said base;

a shaft mounted for rotational movement within said housing;

a first cradle upstanding from said base;

a second cradle upstanding from said base; and a lever arm affixed to said shaft, said lever arm including a handle defining a closed area, said lever arm and handle movable arcuately between a first position contacting said first cradle and a second position contacting said second cradle, said first position and said second position separated by an angle 120 degrees or less.

2. The switch stand of claim 1 further comprising:

a link connected to said shaft;

a spindle connected to said link and projecting beneath said housing; and a connecting rod attached to said spindle and configured for axial movement relative to said shaft.

3. The switch stand of claim 1 wherein said first cradle and said second cradle are separate from said housing.

4. The switch stand of claim 1 wherein said lever arm reaches at least 18 inches above the height of said shaft when in said first position or said second position.

5. The switch stand of claim 1 further comprising a locking device mounted on each of said first and second cradles that retains said lever arm in said first and second position.

6. The switch stand of claim 5 wherein said lever arm is held in said locking device at an angle of about 40 to 45 degrees from a plane of said base.

7. The switch stand of claim 1 wherein said lever arm comprises an elongated bar.

8. The switch stand of claim 7 wherein said lever arm is elongated to a length of at least 36 inches.

9. A switch stand for moving switching rails from a first setting to a second setting, said stand comprising:

a base;

a housing fixed to said base;

a shaft mounted for rotational movement within said housing;

a first cradle upstanding from said base, said first cradle including a first foot lock mechanism;

a second cradle upstanding from said base, said second cradle including a second foot lock mechanism;

a lever arm having a first end and a second end, said first end of said lever and secured to said drive shaft;

a handle fixed to said second end of said lever arm, said handle including a member defining a closed area;

said lever arm and handle movable arcuately between a first position wherein said lever arm is supported by said first cradle at an angle of approximately 30 degrees to the plane of said base, and a second position wherein said lever arm is supported by said second cradle at an angle of approximately 30 degrees to the plane of said base;

said rails set at said first setting when said lever arm is in said first position, and said rails set at said second setting when said lever arm is in said second position; and said first position and said second position separated by an angle of approximately 120 degrees.

10. The switch stand of claim 9 wherein the highest point of said handle when said lever arm is in said first position is at least 18 inches above said base.

11. A switch stand comprising:

a housing defining a base;

a shaft mounted for rotational movement within said housing;

a first locking mechanism attached to said base;

a second locking mechanism attached to said base; and a lever arm affixed to said shaft, said lever arm including a handle defining a closed area adjacent said lever arm, said lever arm and handle movable arcuately between a first position contacting said first locking mechanism and a second position contacting said second locking mechanism, said first position and said second position separated by an angle less than approximately 120 degrees.

12. The switch stand of claim 11 wherein said handle further comprises a bar member bent to define a closed area.

13. The switch stand of claim 11 wherein said lever arm, when in said first position, forms an angle of approximately 30 degrees to the plane of said base.

14. The switch stand of claim 11 wherein said lever arm, when in said first position, forms an angle of approximately 45 degrees to the plane of said base.

15. The switch stand of claim 11 wherein said lever arm further comprises a straight bar.

16. The switch stand of claim 11 wherein said handle further comprises a bar member defining at least one grasping portion spaced from said lever arm.

17. The switch stand of claim 16 wherein said grasping portion is elevated by an angle at least 30 degrees from the plane of said base when said lever arm is in said first position.

18. The switch stand of claim 11 wherein said first locking mechanism further comprises a first cradle upstanding from said base for receiving said lever arm.

19. The switch stand of claim 18 wherein said second locking mechanism further comprises a second cradle upstanding from said base for receiving said lever arm.

20. The switch stand of claim 18 further comprising a first foot-actuated locking mechanism on said cradle engageable with said lever arm to retain said lever arm in said first position.

21. The switch stand of claim 20 further comprising a second foot-actuated locking mechanism on said cradle engageable with said lever arm to retain said lever arm in said second position.

22. A switch stand for moving switching rails from a first setting to a second setting, said stand comprising:

a base;

a housing fixed to said base;

a shaft mounted for rotational movement within said housing;

a first locking mechanism attached to said base;

a second locking mechanism attached to said base;

a lever arm having a first end and a second end, said first end of said lever arm secured to said shaft;

a handle adjacent said second end of said lever arm, said handle including a member defining a closed area;

said lever arm and handle movable arcuately between a first position wherein said lever arm is engaged by said first locking mechanism at an angle of approximately 30 degrees to the plane of said base, and a second position wherein said lever arm is engaged by said second locking mechanism at an angle of approximately 30 degrees to the plane of said base;

said rails set at said first setting when said lever arm is in said first position, and said rails set at said second setting when said lever arm is in said second position; and said first position and said second position separated by an angle of approximately 120 degrees.

23. The switch stand of claim 22 wherein said member of said handle is bent into a closed loop.

24. The switch stand of claim 23 wherein said elongated member of said handle further comprises an elongated bar including at least two portions bent to approximately 90-degree angles.

25. A switch stand for moving switching rails from a first setting to a second setting, said stand comprising:

a base;

a housing fixed to said base;

a shaft mounted for rotational movement within said housing;

a first locking mechanism attached to said housing;

a second locking mechanism attached to said housing;

a lever arm having a first end and a second end, said first end of said lever arm secured to said shaft;

a handle located adjacent said second end of said lever arm, said handle including a member defining a closed area;

said lever arm and handle movable arcuately between a first position wherein said lever arm is engaged by said first locking mechanism, and a second position wherein said lever arm is engaged by said second locking mechanism;

said rails set at said first setting when said lever arm is in said first position, and said rails set at said second setting when said lever arm is in said second position; and said first position and said second position separated by an angle of less than 120 degrees.

26. A switch stand comprising:

a housing defining a base;

a shaft mounted for rotational movement within said housing;

a first locking mechanism attached to said housing;

a second locking mechanism attached to said housing;

a lever arm having a first end and a second end, said first end connected to said shaft, said lever arm extending at least 36 inches between said first end and said second end;

a handle located adjacent said second end of said lever arm, said handle including a member having a grasping portion and defining a closed area; and said lever arm and handle rotatable between a first position wherein said lever arm is engaged by said first locking mechanism, and a second position wherein said lever arm is engaged by said second locking mechanism;

wherein said grasping portion of said member is elevated at least 18 inches above said base when said lever arm is in said first position.

* * * * *

UNITED STATES PATENT AND TRADEMARK OFFICE

CERTIFICATE OF CORRECTION

PATENT NO. : 5,642,870

DATED : July 1, 1997

INVENTOR(S) : Ike Sargis

It is certified that error appears in the above-indentified patent and that said Letters Patent is hereby corrected as shown below:

In the Claims

In claim 5, line 3, change "and" to --or--.

Signed and Sealed this

Sixth Day of March, 2001

*Attest:*

Nicholas P. Godici

NICHOLAS P. GODICI

*Attesting Officer*

*Acting Director of the United States Patent and Trademark Office*